United States Patent [19]

de Souza et al.

[11] 4,224,060

[45] Sep. 23, 1980

[54] HARD ALLOYS

[75] Inventors: Marcos H. C. de Souza; Celso A. Barbosa; Ivan G. S. Falleiros; Fabio Y. Mori; Werner Viertler, all of São Paulo, Brazil

[73] Assignee: Acos Villares S.A., Sao Paulo, Brazil

[21] Appl. No.: 866,164

[22] Filed: Dec. 29, 1977

[51] Int. Cl.[2] ..... C22C 39/02

[52] U.S. Cl. ..... 75/124; 75/126 C; 75/126 E; 75/126 F; 75/126 H; 75/126 J

[58] Field of Search ..... 75/126 C, 126 E, 126 H, 75/126 J, 126 F, 124

[56] References Cited

U.S. PATENT DOCUMENTS

| | | | |
|---|---|---|---|
| 3,833,360 | 9/1974 | Giflo et al. | 75/126 H |
| 3,901,690 | 8/1975 | Philip et al. | 75/126 F |
| 3,907,553 | 9/1975 | Nagumo et al. | 75/126 F |
| 4,036,640 | 7/1977 | Philip et al. | 75/126 F |
| 4,116,684 | 9/1978 | Uchida et al. | 75/126 F |

FOREIGN PATENT DOCUMENTS

| | | | |
|---|---|---|---|
| 513100 | 5/1955 | Canada | 75/126 F |
| 140791 | 6/1953 | Denmark | 75/126 F |
| 2259420 | 7/1973 | Fed. Rep. of Germany | 75/126 H |
| 91218 | 5/1959 | Netherlands | 75/126 E |
| 637222 | 5/1950 | United Kingdom | 75/126F |
| 393355 | 12/1973 | U.S.S.R. | 75/126 C |

OTHER PUBLICATIONS

Roberts et al.; "Tool Steels", ASM, 1962, pp. 707–713.

*Primary Examiner*—M. J. Andrews

*Attorney, Agent, or Firm*—Emory L. Groff, Jr.

[57] ABSTRACT

This invention relates to hard alloys with a chemical composition by weight of 0.7 to 1.5% carbon; 0.1 to 1.0% silicon; 0.15 to 0.50% manganese; 0.03% maximum phosphorus; 0.20% maximum sulphur; 3.5 to 6.0% chromium; 0 to 10% molybdenum; 0 to 10% tungsten; 0 to 4.0% vanadium; 0.1 to 7.0% niobium; 0.2 to 12% cobalt; 0.08% maximum nitrogen; 0.25% maximum aluminum, the balance being iron, and which alloys contain in their raw melt structure and after hot deformation, individual (segregated) single niobium carbides or individual (segregated) double niobium and vanadium carbides, with a morphology controllable by the fabrication technique. After a suitable heat treatment, such alloys have an improved machinability performance over the conventional alloys (containing no niobium).

1 Claim, 17 Drawing Figures

HARD ALLOYS

Present invention relates to hard alloys. There will be disclosed the development of alloys containing iron, manganese, carbon, silicon, cobalt, chromium, molybdenum, tungsten, vanadium, niobium and nitrogen and having residual contents of other elements usual in the manufacture of steel.

These novel alloys are characterized by the presence of niobium in their chemical composition and by the formation of individual (segregated) single niobium carbides or by the formation of individual (segregated) double vanadium and niobium carbides, in the raw melt structure besides the eutetic carbides rich in tungsten and molybdenum.

The ranges of chemical composition in percent by weight of these alloys are as follows:

Carbon: 0.7 to 1.5%
Silicon: 0.1 to 1.0%
Manganese: 0.15 to 0.50%
Phosphorus: 0.030% maximum
Sulphur: 0.20% maximum
Chromium: 0.30 to 6.0%
Molybdenum: 0 to 10%
Tungsten: 0 to 10%
Vanadium: 0 to 4.0%
Niobium: 0.1 to 7.0%
Aluminum: 0.25% maximum
Cobalt: 0.2 to 12.0%
Nitrogen: 0.08% maximum
Iron: balance The invention is illustrated by the accompanying drawings in which:

FIGS. 4 through 7 show the morphological control of the individual (segregated) carbide particle form by the use of modifying agents, as discussed below, whereas

Figure 1:
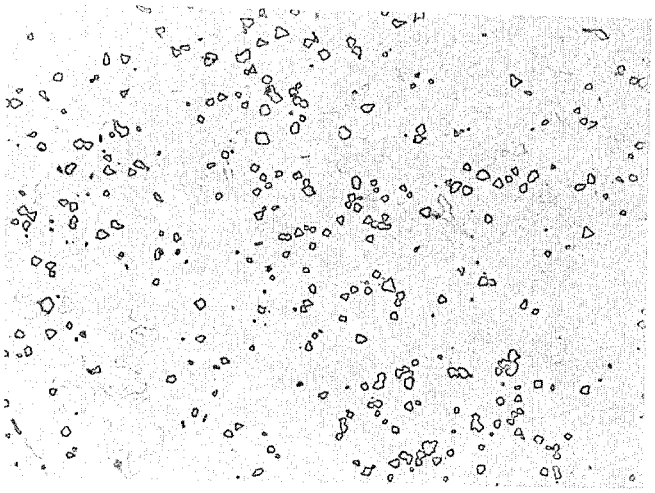
FIGS. 1 through 3 show typical microstructures of said alloys in the raw melt condition.
Figure 2:
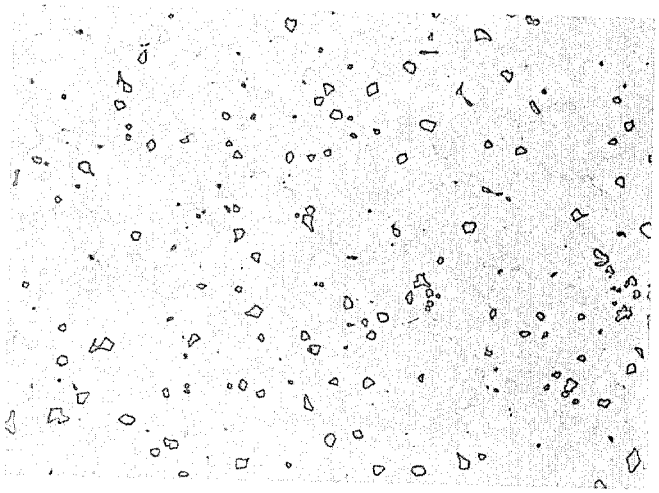
Figure 3:
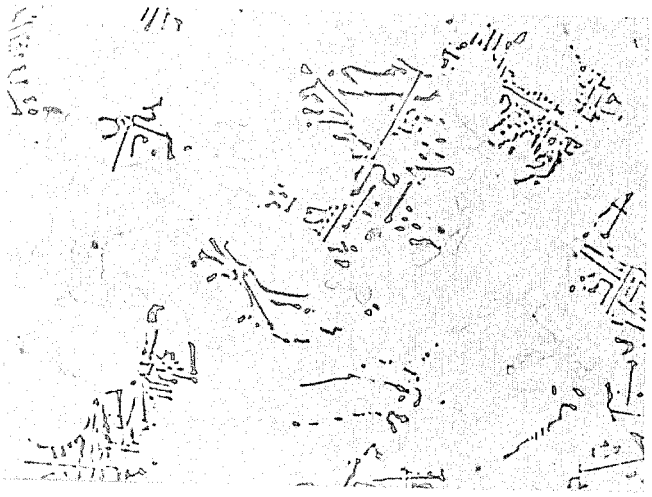
Figure 4:
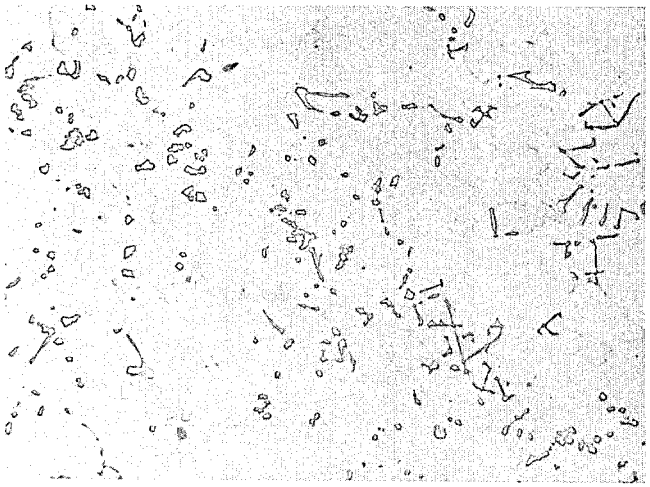

Typical microstructures of said alloys in the raw melt condition for a base composition having by weight 4.0% chromium, 8.0% tungsten, 4.5% molybdenum, 10% cobalt and different contents of vanadium and niobium are shown in the figures disclosed below, which have been all enlarged at the same scale-200 times-and obtained without any etching; FIG. 1 (0.2% vanadium and 2.5% niobium), FIGS. 2 and 3 (2.7% niobium) and FIG. 4 (0.5% vanadium and 2.2% niobium). It is to be noted in FIGS. 2 and 3, the different morphologies that the individual carbides can assume (square or in thread form).

In general, the morphology of the individual (segregated) carbides is altered by the vanadium content, the niobium content, the niobium to vanadium ratio, the action of aluminum and other deoxidants and by the fabrication method, the other above mentioned chemical elements having little influence.

Figure 5:
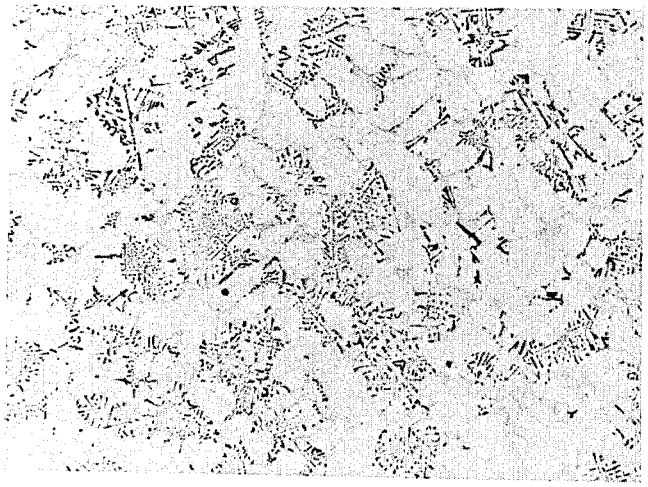
Figure 6:
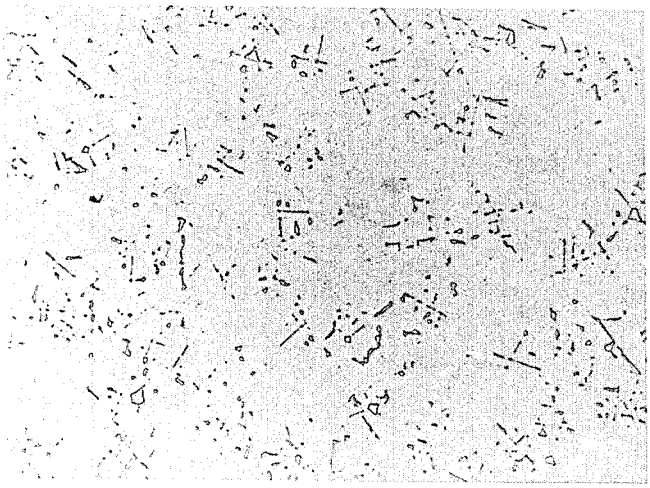

The control of the form of the individual carbide may be effected by using deoxidants, such as: aluminum, titanium, rare earth metals, calcium, silicon, zirconium, and combinations thereof, in amounts of up to 0.4% of the total charge. The effect of aluminum is shown in FIG. 5 (200 times, without etching). The deoxidation may be also carried out under vacuum, viz. under pressure below 6650 $N/m^2$, and the effect is shown in FIG. 6 (200 times, without etching). Sometimes, we do not need to use such techniques if we add an iron-niobium alloy having a small particle size, say less than 30 mesh, and pouring or casting immediately after this addition.

Figure 7:
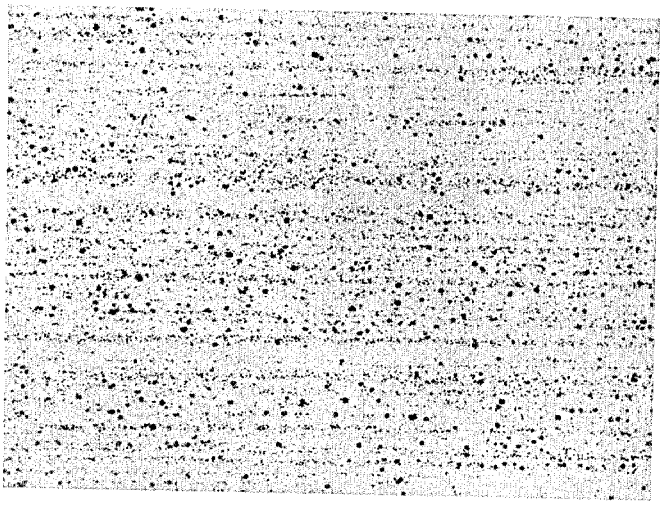
Figure 8:
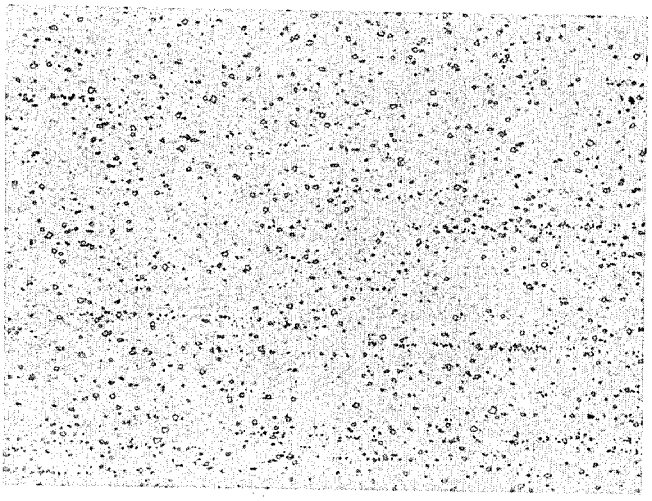
FIG. 8 shows the influence of increasing the content of niobium and simultaneous decreasing the content of vanadium.
Figure 9:
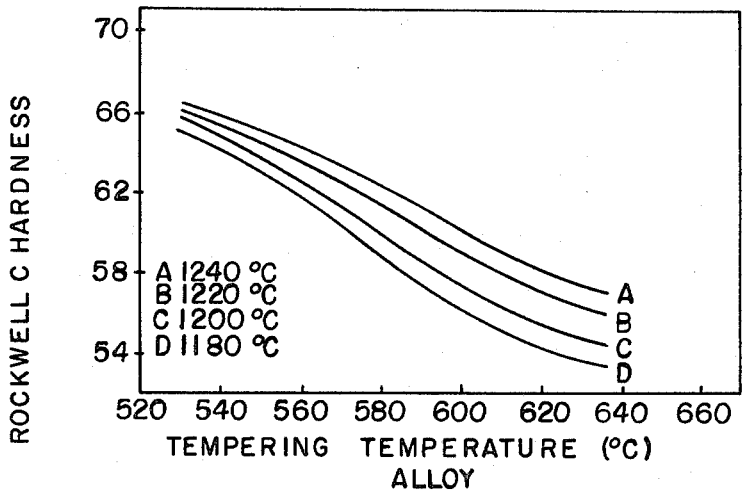
FIGS. 9 through 15 are graphs showing the hardnesses obtained with novel alloys numbered 1 to 7.
Figure 10:
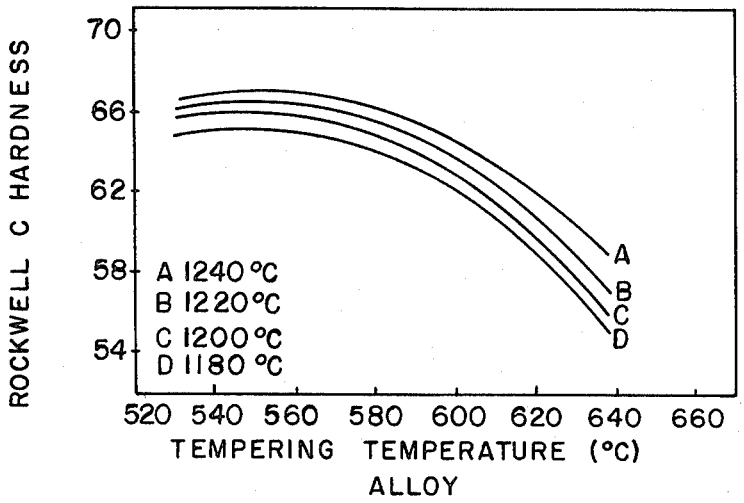
Figure 11:
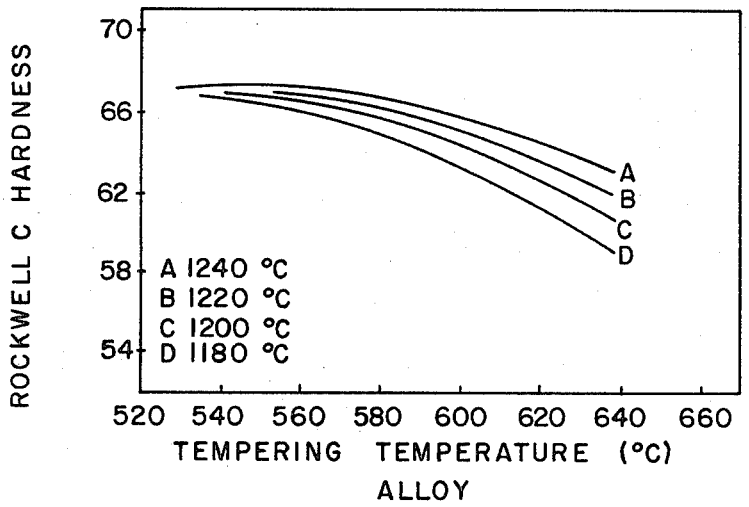
Figure 12:
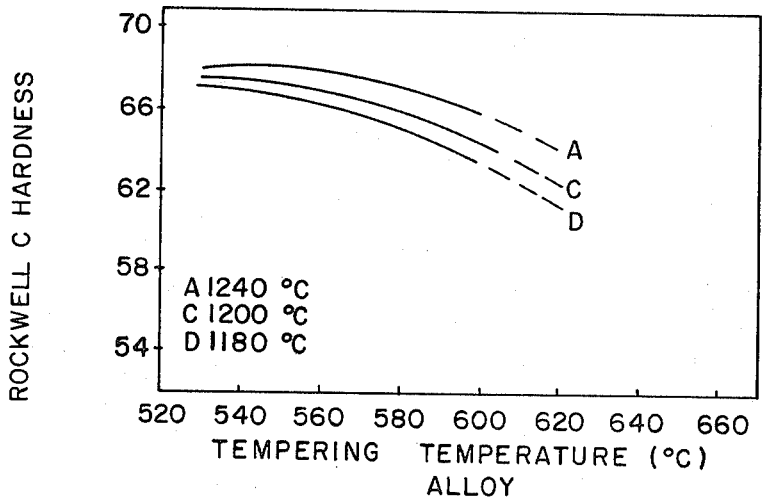
Figure 13:
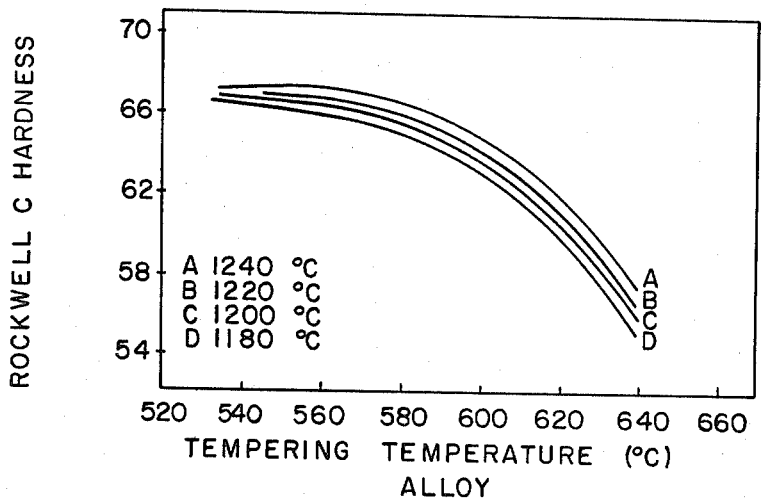
Figure 14:
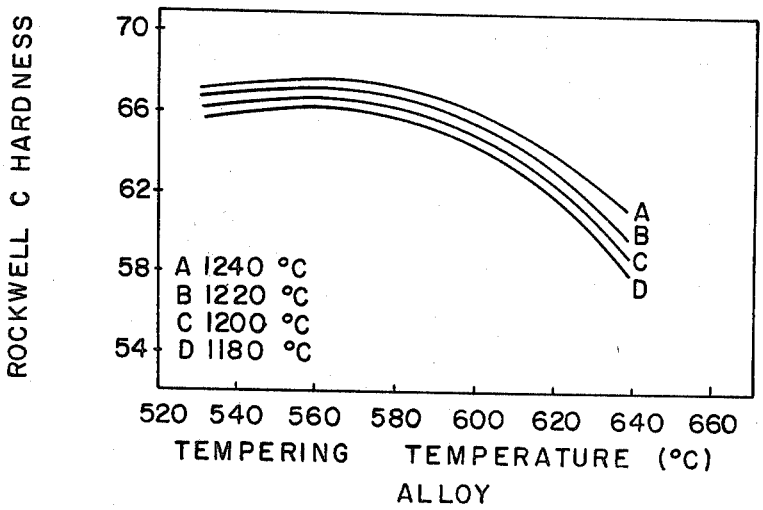
Figure 15:
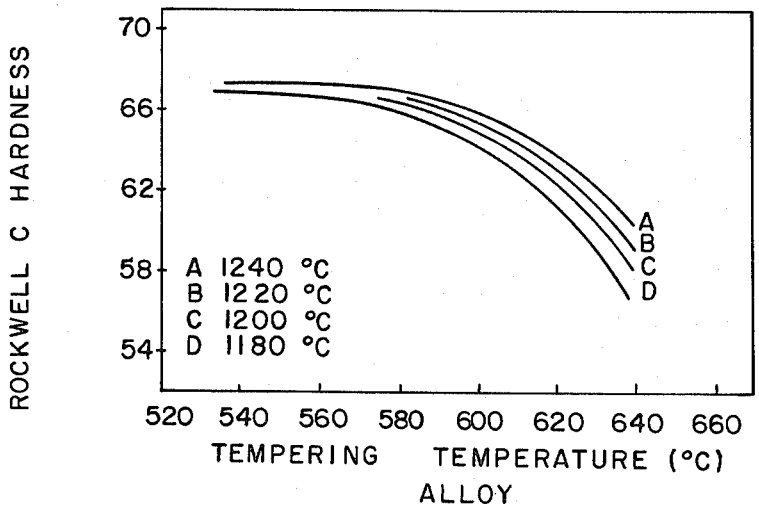

The morphology of the individual carbides varies in the final product, depending upon the raw melt structure, the vanadium and niobium content, the method of fabrication in the steel-shop and rolling reduction used. FIG. 7 (alloy 4—Table 1) enlarged 100 times shows the electrolytic etching, and the distribution and size of the individual carbides. FIG. 8 (alloy 2—Table 1) enlarged 100 times and without etching, shows the effect of increasing the niobium content and simultaneously decreasing the vanadium content.

Such alloys have a plasticity for forging and rolling which is equivalent to the commercially available alloys having similar composition and they can be forged and rolled in conventional equipment.

The heat treatments of these alloys are carried out in molten salt baths, and the austenitizing should be effected at between 1100° and 1260° C., with cooling up to 15 minutes, in another bath kept at a temperature between 400° and 600° C., and with further cooling in air. Tempering should be effected between 400° and 650° C., depending on the desired hardness, and it should be performed at least two times, in order to avoid an excessive quantity of retained austenite. As an alternative, furnaces with a protective atmosphere or even under vacuum may be used to avoid decarburizing. Austenitizing should be effected in the temperature ranges as stated above.

The hardnesses obtained after hardening and tempering in salt baths for the alloys numbered 1 to 7 (Table 1), are shown in FIGS. 9 to 15. These tempering curves were plotted by varying the austenitizing temperature between 1180° to 1240° C. and by effecting double temperings each of two hours, in the range of from 530° to 650° C.

TABLE 1

| Alloy | 1 | 2 | 3 | 4 | 5 | 6 | 7 |
|---|---|---|---|---|---|---|---|
| C | 0.87 | 1.22 | 1.33 | 1.27 | 1.14 | 1.18 | 1.26 |
| Si | 0.47 | 0.38 | 0.38 | 0.23 | 0.34 | 0.30 | 0.38 |
| Mn | 0.31 | 0.28 | 0.27 | 0.25 | 0.26 | 0.23 | 0.24 |
| P | 0.029 | 0.024 | 0.024 | 0.023 | 0.031 | 0.029 | 0.027 |
| S | 0.029 | 0.030 | 0.030 | 0.012 | 0.030 | 0.025 | 0.023 |
| Al | 0.002 | 0.003 | 0.003 | 0.015 | 0.010 | 0.009 | 0.011 |
| Cr | 3.71 | 3.42 | 3.42 | 4.07 | 4.12 | 3.93 | 3.90 |
| W | 7.97 | 8.27 | 8.78 | 8.10 | 7.75 | 8.18 | 8.28 |
| Mo | 4.31 | 4.56 | 4.60 | 4.62 | 4.52 | 4.38 | 4.58 |
| Nb | 2.68 | 2.72 | 2.73 | 0.16 | 2.65 | 2.18 | 1.63 |
| V | — | — | — | 2.70 | 0.20 | 0.51 | 0.91 |
| N | 0.008 | 0.006 | 0.006 | 0.020 | 0.009 | 0.010 | 0.009 |
| Co | 9.76 | 9.81 | 9.71 | 9.98 | 10.02 | 10.00 | 9.70 |

Figure 16:
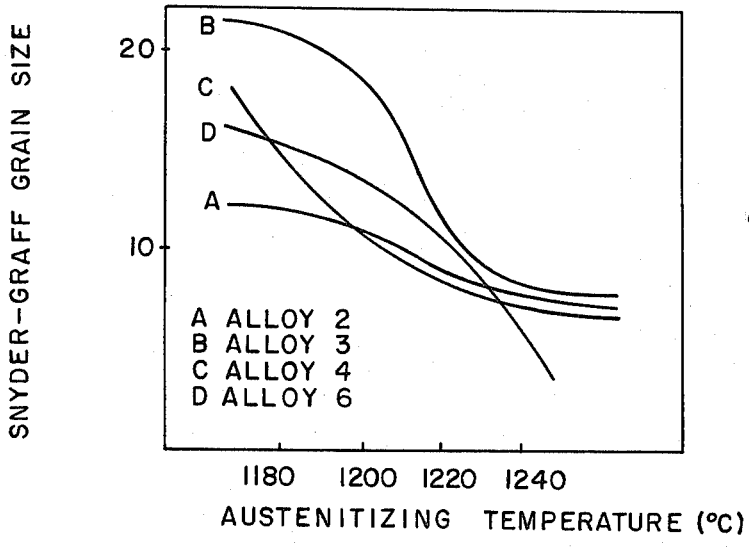
FIGS. 16 and 17 are related to technical effects and advantages shown by these alloys.

The introduction of niobium refines the austenitic gain as determined by the Snyder-Graff method. Such refining depends on the morphology and distribution of the individual carbide and upon the used rolling reduction degree. This effect is shown in FIG. 16 for certain compositions. Alloy 4 underwent the greatest reduction degree, followed by alloy 3 and alloys 1 and 2 (same reduction).

Tools made from such alloys were tested as to machinability, as compared to an alloy deprived of niobium and containing vanadium (1.3% C, 4.20% Cr, 4.50% Mo, 8.0% W, 2.9% V, 10% Co, 0.015% S, 0.021% P, 0.29% Mn). The tool made from this alloy was designated A. The other tools are designated as follows:

B—alloy 1
C—alloy 2
D—alloy 5
E—alloy 6
F—alloy 7

The geometry of the tools used had the following properties:

Clearance angle = +7°
Output angle = +10°
Inclination angle = +4°
Position angle = 60+
Curvature radius = 1 mm There was used a feed of 0.202 mm/turn with a cutting depth p = 2 mm.

Figure 17:
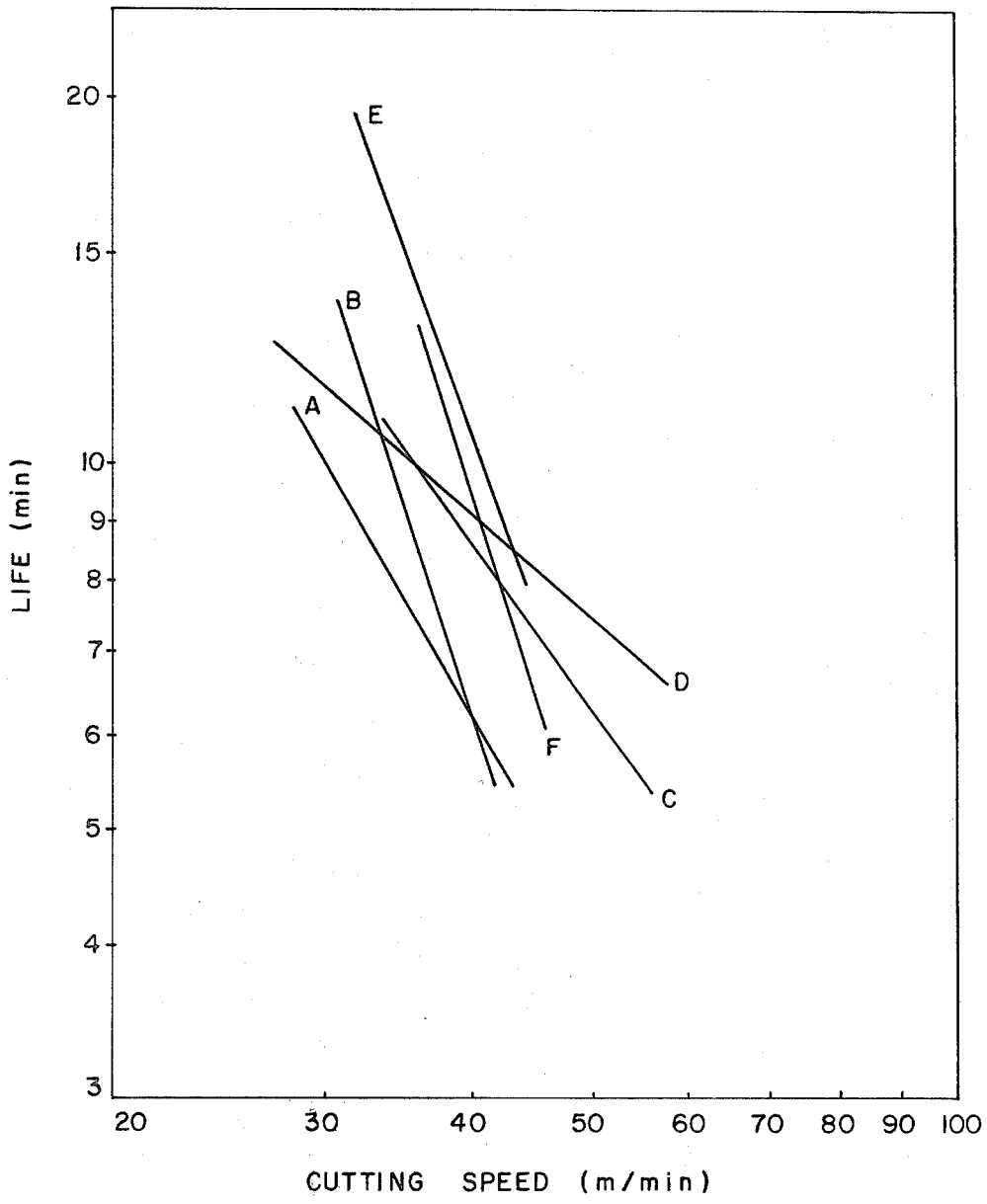

The material thus machined was a SAE-4340 steel which had been hardened and tempered to a hardness of 300 HB. The life of the tool as a function of the cutting speed is shown in FIG. 17, for a wear width $I_L$=0.6 mm.

The tools made from the new steels have a substantially longer life than the tools made of steel without niobium. For example, for a cutting speed of 35 m/min, tool E made from alloy 6 has a life 100% greater than tool A, made from the alloy which contains no niobium.

We claim:

1. A hard steel alloy having in the as cast and wrought structure idiomorphic, isolated niobium carbides in the case of alloys containing no vanadium and idiomorphic, isolated carbides of vanadium and niobium in the case of alloys containing vanadium consisting of, by weight, 0.7 to 1.50% carbon, 0.1 to 1.0% silicon, 0.15 to 0.50% manganese, up to 0.03% phosphorous, up to 0.20% sulfur, 3.50 to 6.0% chromium, 0 to 10.0% molybdenum, 0.0 to 10.0% tungsten, 0.0 to 4.0% vanadium, 0.2 to 12.0% cobalt, up to 0.08% nitrogen, up to 0.25% aluminum, 0.1 to 7.0% niobium, the balance iron and incidental impurities.

* * * * *